US006922918B2

(12) United States Patent
Issler

(10) Patent No.: US 6,922,918 B2
(45) Date of Patent: Aug. 2, 2005

(54) METHOD AND APPARATUS FOR A SHOE HAVING AN ODOR AND MOISTURE ABSORBENT PAD

(75) Inventor: James E. Issler, Greenwich, CT (US)

(73) Assignee: H. H. Brown Shoe Technologies Inc., Greenwich, CT (US)

( * ) Notice: Subject to any disclaimer, the term of this patent is extended or adjusted under 35 U.S.C. 154(b) by 0 days.

(21) Appl. No.: 10/280,654

(22) Filed: Jan. 29, 2003

(65) Prior Publication Data

US 2004/0143997 A1 Jul. 29, 2004

(51) Int. Cl.[7] ..... A43B 13/38; A43B 23/00; A43B 13/18; A43B 19/00

(52) U.S. Cl. ..... 36/71; 36/28; 36/44

(58) Field of Search ..... 36/88, 91, 92, 36/93, 3 B, 28, 30 R, 31, 71, 3 A, 44

(56) References Cited

U.S. PATENT DOCUMENTS

| | | | | | |
|---|---|---|---|---|---|
| 2,340,603 | A | * | 2/1944 | Lyness | 36/3 R |
| 2,435,131 | A | | 1/1948 | Desbiens | |
| 4,257,176 | A | | 3/1981 | Hartung et al. | |
| 4,689,899 | A | | 9/1987 | Larson et al. | |
| 4,794,030 | A | | 12/1988 | Celia | |
| 4,854,993 | A | | 8/1989 | Celia | |
| 4,866,860 | A | * | 9/1989 | Bissett et al. | 36/28 |
| 4,919,746 | A | | 4/1990 | Celia | |
| 4,942,679 | A | | 7/1990 | Brandon et al. | |
| 5,357,689 | A | * | 10/1994 | Awai | 36/3 R |
| 5,405,648 | A | | 4/1995 | Hermann | |
| 5,588,226 | A | * | 12/1996 | Schenkel | 36/3 B |
| 5,718,064 | A | | 2/1998 | Pyle | |
| 5,732,485 | A | * | 3/1998 | Laughlin et al. | 36/3 B |
| 5,787,608 | A | * | 8/1998 | Greenawalt | 36/88 |
| 5,829,167 | A | * | 11/1998 | Valenzuela | 36/3 B |
| 5,935,671 | A | * | 8/1999 | Lhuillier | 36/71 |
| 5,976,847 | A | | 11/1999 | Hermann | |
| 6,038,790 | A | | 3/2000 | Pyle et al. | |
| 6,227,458 | B1 | * | 5/2001 | Dever et al. | 36/71 |
| 6,256,824 | B1 | | 7/2001 | Austin et al. | |
| 6,408,544 | B1 | * | 6/2002 | Hernandez | 36/30 R |
| 6,508,017 | B1 | * | 1/2003 | DeBarro et al. | 36/28 |
| 6,684,530 | B2 | * | 2/2004 | Opazo | 36/3 B |

FOREIGN PATENT DOCUMENTS

| | | |
|---|---|---|
| JP | 7000206 | 1/1995 |

* cited by examiner

*Primary Examiner*—Anthony Stashick
(74) *Attorney, Agent, or Firm*—St. Onge Steward Johnston & Reens LLC

(57) ABSTRACT

The invention includes a shoe having an outsole with an upper surface, a vamp placed on top of the upper surface, and a pad placed between the upper surface and the vamp. The pad has odor and moisture adsorbing properties and the vamp includes at least one aperture proximate to the pad for permitting moisture and odor to diffuse through the at least one aperture and contact the pad.

15 Claims, 5 Drawing Sheets

METHOD AND APPARATUS FOR A SHOE HAVING AN ODOR AND MOISTURE ABSORBENT PAD

FIELD OF THE INVENTION

The invention relates to a shoe that reduces odor and moisture and, more particularly, a pad having odor and moisture absorbent properties placed between the outsole and upper of the shoe.

BACKGROUND OF THE INVENTION

Although shoes have a variety of appearances and are worn for a variety of reasons, such as dress shoes for formal occasions and athletic shoes for sporting events, shoes are conventionally constructed to include at least an upper and an outsole.

Traditionally, the outsole typically makes contact with the ground and is generally of a tough material that protects a users—foot. The upper is connected to the outsole and usually forms a cavity that surrounds the foot for holding the outsole to the bottom of the foot. The upper is normally made of a comfortable material since it contacts the foot, such as leather or other fabric that is generally softer than the outsole.

Because shoes may be worn for many hours of every day, numerous advancements have been made to improve a shoe's comfort, such as softening the uppers or making the outsole more flexible. In addition, for a moccasin constructed shoe, where the upper extends downwardly beneath and across the bottom of the foot for defining a bottom of the upper (see FIG. 2 bottom of the upper 22), the bottom of the upper may be thickened to improve cushioning and comfort to the feet. However, by providing additional cushioning to the foot, moisture and odor may be trapped in the cushioning and/or inhibited from escaping the shoe, thereby reducing the comforting effects of the thickened cushion. Moreover, retained moisture may lead to bacterial growth, athlete's foot, and other fungal problems. Usually, reducing or repelling moisture improves a likelihood of keeping the feet dry, which may reduce bacterial growth and other problems often associated with damp feet and/or shoes.

U.S. Pat. No. 4,689,899 to Larson et al. ("Larson") appears to relate to a layered construction of an inner sole that cushions and repels moisture to the feet. Typically, the inner sole of Larson involves three layers where foam and non-woven fibers may be used to reduce or repel moisture transmission.

U.S. Pat. No. 4,257,176 Hartung et al. ("Hartung") appears to relate to a shoe that counters foot odor by releasing volatile fragrances or materials that interact with the bacteria that causes odor. Droplets or pockets filled with such fragrances or materials are typically provided in a layer of the insole and, upon compression by a user's foot, the fragrances or materials may be released via holes in the insole.

U.S. Pat. Nos. 5,718,064 and 6,038,790 to Pyle ("Pyle") appear to relate to an odor combating and moisture absorbent layer of foam which may be on top of, or a part of, the insole. The foam is disclosed to be a urethane product that softens as the temperature inside the shoe increases. U.S. Pat. No. 4,942,679 to Brandon et al. ("Brandon") also seems to disclose a urethane foam product for absorbing moisture. Because of its thickness, the foam used in Brandon may require a cavity, or recess in the outsole or insole, to place the foam for controlling the overall thickness of the shoe.

JP 7000206 to Nakamura ("Nakamura") also seems to disclose a shoe that counters foot odor and absorbs moisture by placing a leaf between layers of the shoe.

What is desired, therefore, is a shoe having improved moisture absorption. What is also desired is a shoe having improved moisture expulsion properties to help maintain dryness. Another desire is to provide a shoe that combats odor. A further desire is to provide an odor and/or moisture absorbing layer in a shoe without substantially increasing an overall thickness of the shoe.

SUMMARY OF THE INVENTION

Accordingly, it is an object of the invention to provide a shoe having improved moisture and/or odor absorbing capabilities.

Another object of the invention is to provide a shoe with a layer that helps maintain dryness and combats odor without making the shoe unnecessarily thick to accommodate such a layer.

These and other objects of the invention are achieved by provision of a shoe having an outsole with an upper surface, a bottom of the upper placed on top of the upper surface, and a pad placed between the upper surface and the bottom of the upper. The pad has odor and moisture adsorbing properties and the bottom of the upper includes at least one aperture proximate to the pad for permitting moisture and odor to diffuse through the at least one aperture and contact the pad.

Because the pad is relatively thin when compared to traditional moisture and odor absorbing pads, the pad is placed between the bottom of the upper and the upper surface without a need for a cavity to accommodate the pad.

The pad may be in contact with both the upper surface and bottom of the upper. Alternatively, a protector may be placed on top of the pad and beneath the bottom of the upper or beneath the pad and above the upper surface or in both locations for protecting the pad from wear.

The pad may be a hydrophilic material, such as hydrophilic urethane. The pad may also be located in any localized area of the upper surface for absorbing moisture and/or odor, such as a forepart, rearpart, or covering the entire upper surface.

In another embodiment, the shoe may have only odor absorbing capabilities or only moisture absorbing capabilities instead of having both.

The invention and its particular features and advantages will become more apparent from the following detailed description considered with reference to the accompanying drawings.

DETAILED DESCRIPTION OF THE DRAWINGS

Figure 1:
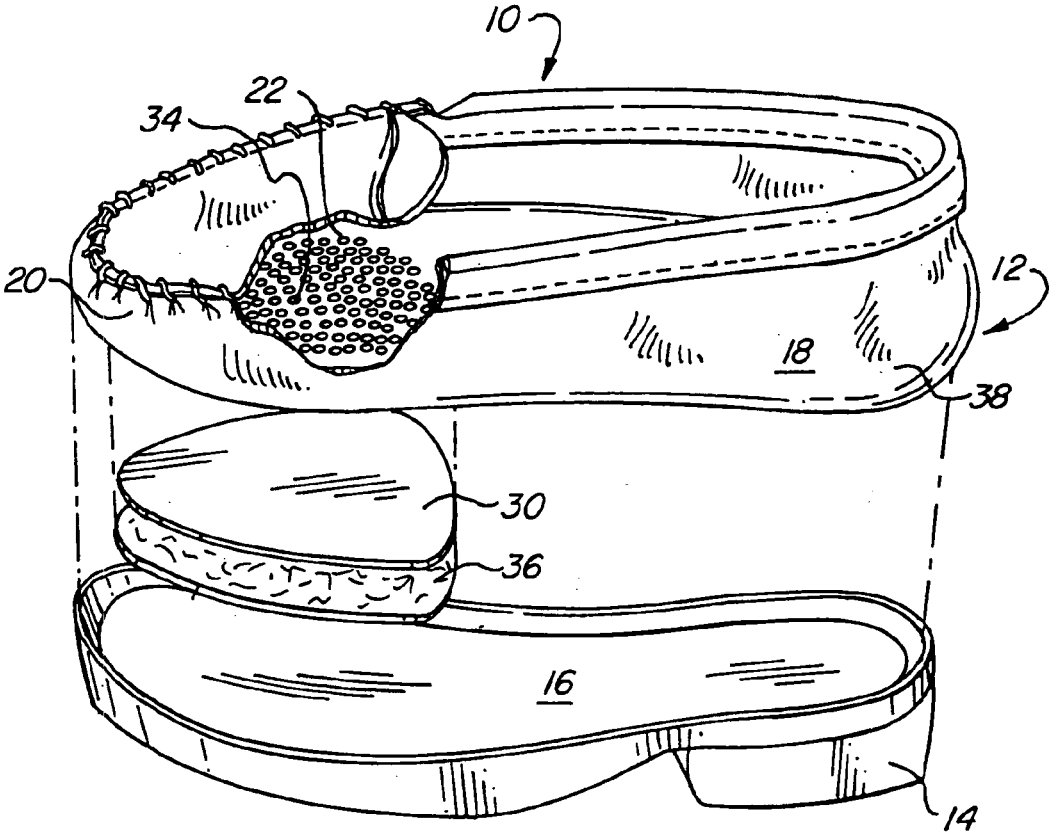
FIG. 1 depicts the shoe in accordance with the invention.

FIG. 1 depicts a shoe 10 having a pad 30 in accordance with the invention. Shoe 10 also includes an upper 12, outsole 14, and upper surface 16 of outsole 14. Upper 12 further includes a side 18 that extends down toward outsole 14, across upper surface 16 from one side to an opposite side of upper surface 16, and upwardly away from upper surface 16. The area of upper 12 that extends across upper surface 16 in a forepart 20 of shoe 10 is known as a bottom of the upper 22.

As shown, pad 30 is placed between bottom of the upper 22 and upper surface 16. Pad 30 has odor and moisture absorbing properties for making the user's foot more comfortable. The odor and moisture absorbing properties of pad 30 is more particularly described below under FIGS. 4, 5, 5A, and 5B.

Figure 2:
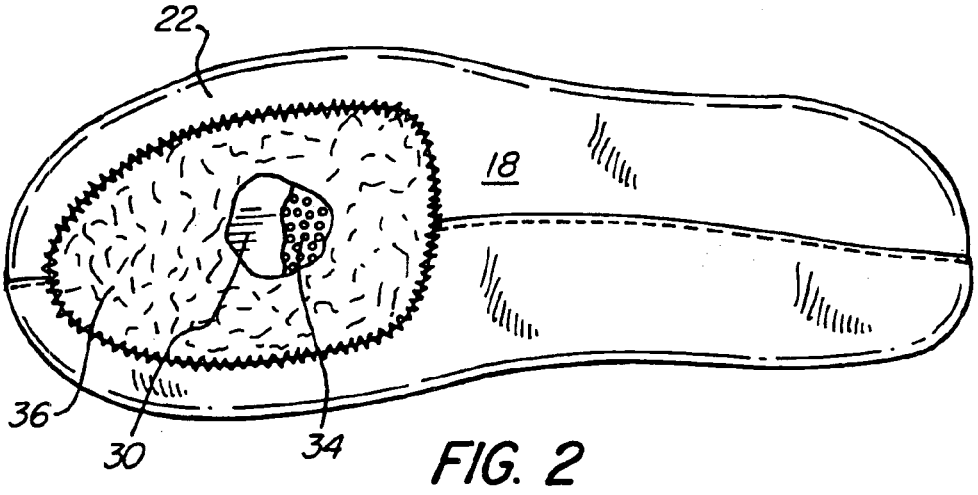
FIG. 2 depicts a bottom view of the shoe of FIG. 1 without the outsole.
Figure 2A:
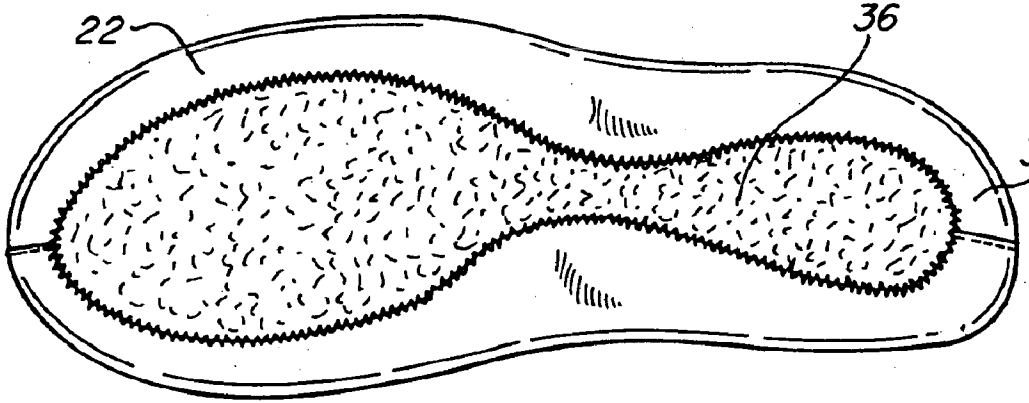
FIG. 2*a* another embodiment of the moisture and odor absorbent pad in accordance with the invention.

As shown in FIGS. 1 and 2, pad 30 is in at least one localized area, such as a forepart 20 of shoe 10. In other embodiments, shown in FIG. 2*a*, pad 30 is in other areas, such as a rearpart 38 of shoe 10 or covering the entire upper surface 16. For the purposes of clarity, the outsole is not shown in FIGS. 2 and 2*a*.

Optionally, shoe 10 may include a protector 36 placed between pad 30 and upper surface 16 to protect pad 30 from abrasions and wear typically resulting from continuous contact with outsole 14, which is generally made of a resilient and tough material to withstand impact, contact, and flexing against the ground caused by walking. Similarly, shoe 10 may optionally include a lubricant or other friction reducing agent placed between pad 30 and upper surface 16 to protect pad. The lubricant may be between the pad and protector, protector and upper surface, or both. The lubricant may also be used in the absence of a protector.

Figure 3:
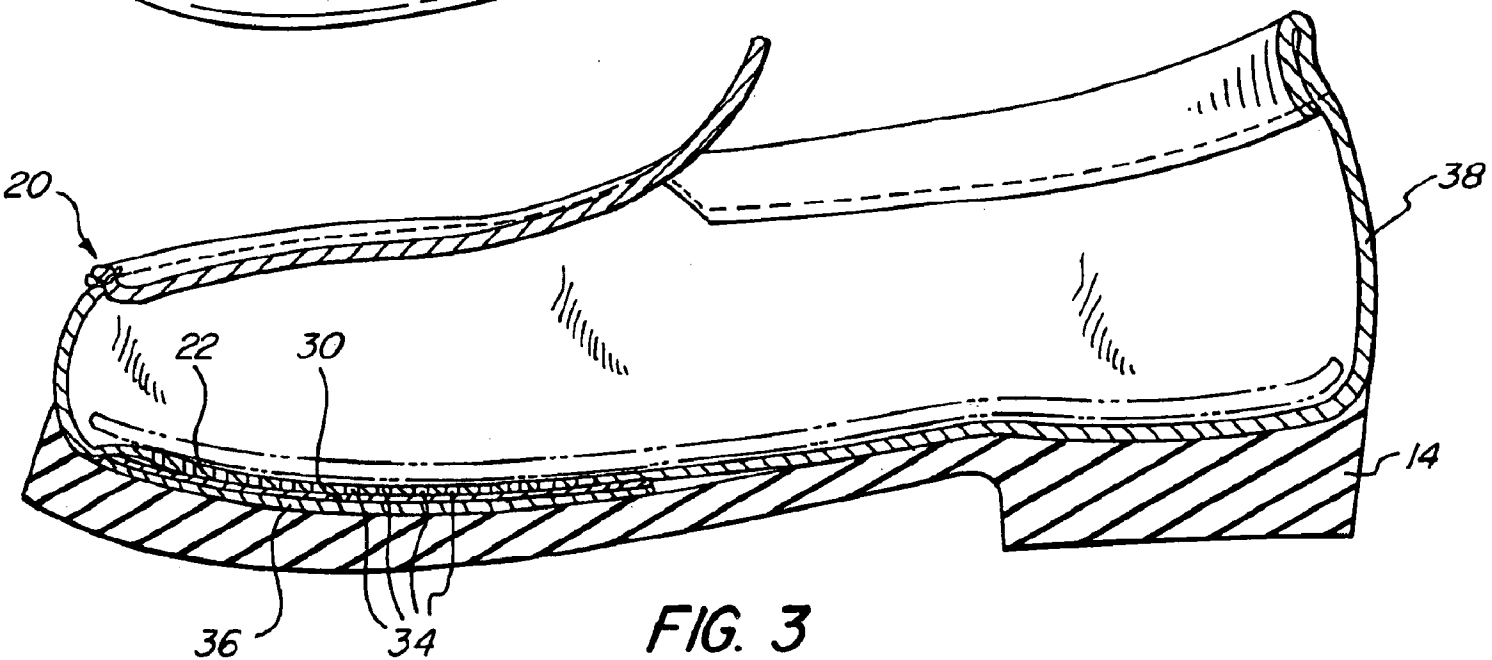
FIG. 3 depicts a cross sectional view of the shoe shown in FIG. 1.

As shown in FIGS. 1–3, bottom of the upper 22 includes at least one aperture 34 in an area proximate to pad 30 so that moisture and odor may pass through bottom of the upper 22 toward pad 30. Generally, a user's foot is placed on top of bottom of the upper 22 and pad 30. Due to at least one aperture 34 being proximate to pad 30, moisture and/or odor from the user's foot passes from the foot through at least one aperture 34 to pad 30.

In further embodiments of the invention, at least one aperture 34 may be of a particular geometry and/or orientation to more effectively permit moisture and/or odor to pass from the foot to pad 30. For example, at least one aperture 34 may be conical, elliptical, frustoconical, or tapered. In addition, at least one aperture 34 may have a cross section that is angled or curved. In still other embodiments, at least one aperture is hourglass shaped or asymmetrical.

In other embodiments, a plurality of apertures 34 may be provided in a pattern that resembles the foot. In further embodiments, the plurality of apertures 34 may be in rows, columns, arcs, and/or random.

These combinations of geometries and orientations of at least one aperture 34 may, when compressed by a foot during walking, simulate a vacuum where moisture and/or odor is drawn toward pad 30 via at least one aperture 34

In certain embodiments, bottom of the upper 22 is made of leather. In other embodiments, the leather bottom of the upper may be removed and replaced with another bottom of the upper made of a different material, such as a mesh. Where bottom of the upper 22 is of a mesh material, there is no need to provide additional apertures 34 in bottom of the upper 22 because the mesh material inherently has adequate openings.

FIGS. 4, 5, 5A and 5B show pad 30 as a two-layered composite having a cover layer 111 and a foam layer 112 that is hydrophilic with respect to the cover layer 111, which is operatively joined or connected or bonded or otherwise laminated in any suitable way to the cover layer 111 as by needle punching, so that the composite material acts to draw or transfer moisture or bodily fluids from and through the cover layer 111 into the foam layer 112 which acts as a reservoir, to absorb, gel or store and dissipate such moisture or bodily fluid as by evaporation from or by washing of the composite material. After the moisture or bodily fluid is dissipated, from time to time, the composite material can be reused. However, those skilled in the art will recognize that the composite materials formed in accordance with the present invention can also be made of materials so that the composite material can also be disposable rather than reusable.

The foam layer 112 may be first formed by polymerizing an aqueous mixture, having as its principal component one or more sorbents with or without various additives, with a predetermined quantity of a hydrophilic urethane prepolymer binder so that the polymerization of the polyurethane foam forms a matrix binder for the one or more sorbents. While the sorbents have been referred to as the principal component, it will be readily understood by those skilled in the art that the aqueous mixture may consist of various combinations of other components without departing from the scope of the present invention including absorptive fillers, fibrous materials, including non-woven fiber materials, surfactants, thermoformable acrylic latex emulsions, odor absorbents and bactericides. Further and additional components may include citric acid, rubber particles and thermal phase change particles depending on certain advantageous and desirable characteristics or functions to be achieved by the composite material.

The characteristics of the sorbent component may be selected so that the volume, rate of absorption and the retention or gelling of the moisture absorbed under varying ambient conditions of temperature and pressure may be optimized for a given composite material being formed. Preferred sorbents adapted for use in the aqueous mixture are primarily super absorbent polymers available in the commercial marketplace as SAB 800 from STOCKHAUSEN, Greensboro, N.C. 27406; as SANWET IM 1000 from Hoechst Celanese Corporation, Portsmouth Va. 23703; as ARIDAL 1460 from Chendal Corporation, Palatine, Ill. 60067; and as ARASORB 800F from Arakawa Chemical Industries, Limited, Osaka 541, Japan.

These sodium polyacrylate/polyalcohol polymer and co-polymer sorbents are manufactured and sold in free-flowing, discrete solid particles, in powder or granular form, and are characterized by the fact that they have a propensity for absorbing increasing quantities of aqueous fluid. This would normally lead to the complete solution of the polymers into the aqueous mixture. However, due to the chemical characteristics of the polymers and co-polymers, the formation of a gel takes place precluding the solution of the polymer or co-polymers. Other sorbents including polyethylene oxide, sodium carboxymethyl cellulose, and like polymers, desiccants such as silica gel, clays such as bentonite, and the like may be used as well.

Figure 5:
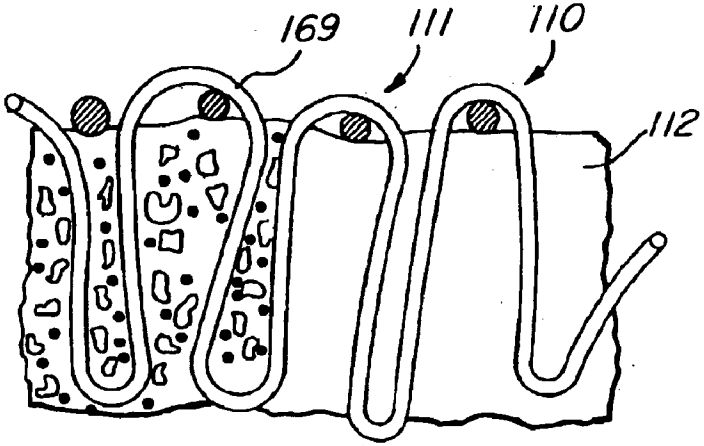
FIG. 5 depicts an enlarged diagrammatic sketch showing in cross-section the elements of the base layer, connected to the cover layer of the composite material, shown in FIG.1 by needle punching.
Figure 5A:
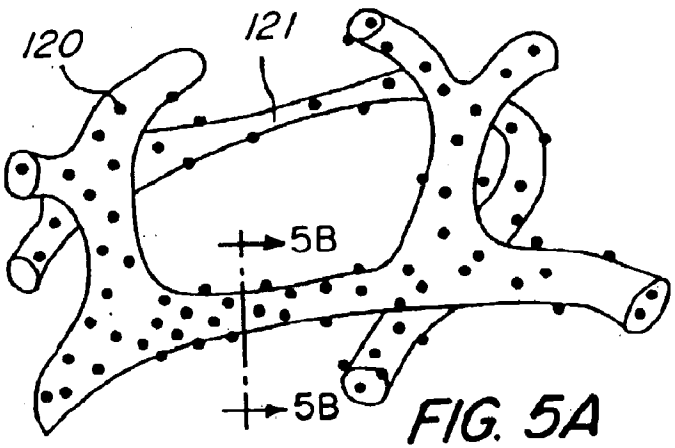
FIG. 5A is an enlarged fragmentary view showing a section of the foam layer of the composite material shown in FIG. 1.
Figure 5B:
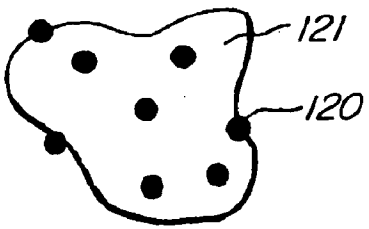
FIG. 5B is an enlarged fragmentary cross-section taken on line 2B—2B of FIG. 2A.

Thus, when an aqueous mixture is metered and mixed with a hydrophilic urethane prepolymer, as more fully described below, the urethane prepolymer reacts with the water in the aqueous mixture to form a hydrophilic polyurethane foam, and at the same time, as shown in FIGS. 5A and 5B, when a sodium polyacrylate sorbent 120 is present, the urethane prepolymer reacts with the sorbent to form a hydrophilic acrylic urethane interpolymer 121.

The combination of the sorbent with the hydrophilic foam thus formed acts in composite materials of either two larger or multiple layers to absorb, adsorb and gel the moisture drawn through the cover layer and to contain and store it so as not to rewet the cover top layer of the layered composite material. The sorbents thus add hydrophilicity to the foam layer of the composite materials.

The additives which may be combined in the aqueous mixture with the sorbents are also available in the commercial marketplace.

Thermoformable acrylic latex emulsions are available from Union Carbide Corporation of New York, N.Y., Rohm & Haas, B. F. Goodrich and others. One preferred form of acrylic emulsion is available from Union Carbide under the trademark "UCAR 154". As is well known to those or ordinary skill in the art, latex emulsions are surfactant-stabilized polymer emulsions, and are commonly used as binders for non-woven materials. The thermoformable latexes form thermoplastic polymer films that are capable of being formed or molded when the film is heated above the glass transition temperature of the polymer.

Use of acrylic latex emulsions in the foam layer of the present invention thus serves as an alternative to the three-layer composite materials of the present invention wherein the third layer is a thermoformable non-woven material bonded to the side of the foam layer remote from the cover layer. The thermoformable acrylic latex emulsions are incorporated into the foam layer by including the emulsion as part of the aqueous mixture reacted with the hydrophilic urethane prepolymer. The water content of the emulsion reacts with the hydrophilic urethane prepolymer to form the polyurethane foam when the aqueous mixture and the urethane prepolymer are reacted together. Thus, the water content of the emulsion should be included as part of the water content of the aqueous mixture when calculating the ratio of the aqueous mixture to be reacted with the urethane prepolymer. Those of ordinary skill in the art will understand that the acrylate component contributed by the thermoformable acrylic latex emulsion is discrete and separate from the acrylate component contributed by the sodium polyacrylic sorbent, when present.

When the foam polymerization is complete, residual water is driven off by drying the foam at a temperature of about 200° F. After bonding of the foam layer to cover layer, the thermoformable acrylic latex, when present, permits the forming or molding of the composite by heating the composite in a mold or other form at a temperature above the glass transition temperature of the acrylic latex, typically a temperature of about 270° F., after which the composite is cooled and removed from the mold or form.

Surfactants useful in the combinations in accordance with the present invention are prepared from nonionic polyethylene and polypropylene oxides such as the BASF surfactant available under the trademark "PLURONIC".

Odor absorption materials are also well known to those skilled in the art and include, activated carbon, green tea, "ABSENT" (UOP); zinc oxide and the like materials.

Bactericides are provided in the commercial marketplace by a myriad of suppliers for controlling bacterial and germ growth. One preferred material is supplied by Lauricidin Co. of Galena, Ill. 61036, under the trademark "LAURICIDIN".

Phase change materials are capable of absorbing approximately 100 BTU/lb. These materials are described in prior art U.S. Pat. Nos. 4,756,958 and 5,254,380.

Other components may be added to the aqueous mixtures, such as citric acid as a buffer for reducing the pH of the water component to increase loading of the sorbent and the fluid characteristic of the aqueous mixture to facilitate pumping of the aqueous mixture; and ground rubber particles from tires available from Composite Particles of Allentown, Pa. increase the resiliency and thermal protection of the composite material. These will be illustrated in the examples of the aqueous mixture more fully set forth below.

The hydrophilic urethane prepolymer component is also available in the commercial marketplace. Suitable prepolymers will be readily recognized by those of ordinary skill in the art and are described in prior art U.S. Pat. Nos. 4,137,200; 4,209,605; 3,805,532; 2,993,013 and general procedures for the preparation and formation of such prepolymers can be found in Polyurethane's, Chemistry and Technology by J. H. Saunders and K. C. Frisch published by John Wiley & Sons, New York, N.Y., at Vol. XVI Part 2, High Polymer Series, "Foam Systems", pages 7–26, and "Procedures for the Preparation of Polymers" , pages 26 et seq.

One preferred form of such prepolymer adapted for use in the present invention because of its strong hydrophilic characteristics and its reasonable price is marketed by Matrix R & D of Dover, New Hampshire as TDI/PEG Urethane Prepolymer under the trademark "BIPOL". These products are polyether urethane polymers of toluene diisocyanate terminated polyethylene glycol with less than six percent (6%) available unreacted NCO groups and a component functionality of two (2) or less.

Another urethane prepolymer is available from W. R. Grace Company of New York, N.Y. sold under the trademark "HYPOL 3000". This "HYPOL" urethane prepolymer is a polyisocyanate capped polyoxylene polyol prepolymer having a component functionality greater than two (2). However, this prepolymer is formulated with a triol which reduces its hydrophilic capability. Therefore, this "HYPOL" urethane prepolymer is less acceptable for the formation of the base layer of the composite material.

Figure 4:
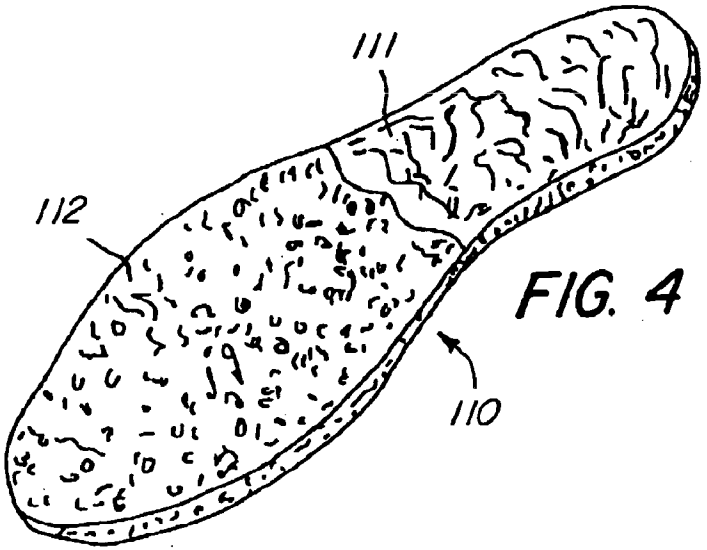
FIG. 4 depicts a perspective view of the pad partly broken away showing a two layered composite material.

When the hydrophilic urethane prepolymer is added in precise amounts to the aqueous mixture, in addition to controlling the absorption characteristics of the final composite material, it has been found that it enhances the composite material so it can be sized and thermoformed into three-dimensional shapes such as the insole for shoes as shown in FIG. 4 of the drawings.

Thus, in the formation of the foam layer, a given aqueous mixture will be blended in ratios of 2 to 10 parts by weight of the aqueous mixture to 1 part by weight of the hydrophilic urethane prepolymer. Controlling in precise amounts the relative ratio of the aqueous mixture to the hydrophilic acrylic urethane prepolymer within these limits does not impair the capabilities of the super-absorbent polymer for absorbing and gelling moisture and body fluids with which the composite material comes into contact.

Figure 7:
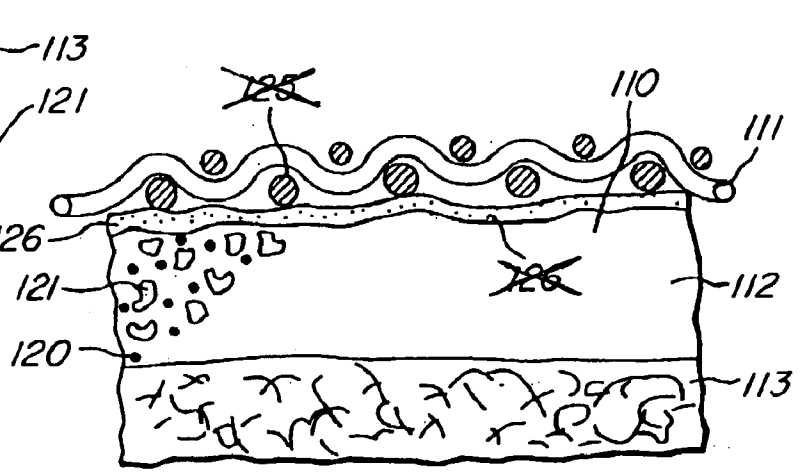
FIG. 7 is an enlarged diagrammatic sketch showing in cross-section the cover layer, the foam layer and the third layer of non-woven fiber web of thermoformable material of the composite material shown in FIG. 1, connected by an adhesive bonding material.
Figure 6:
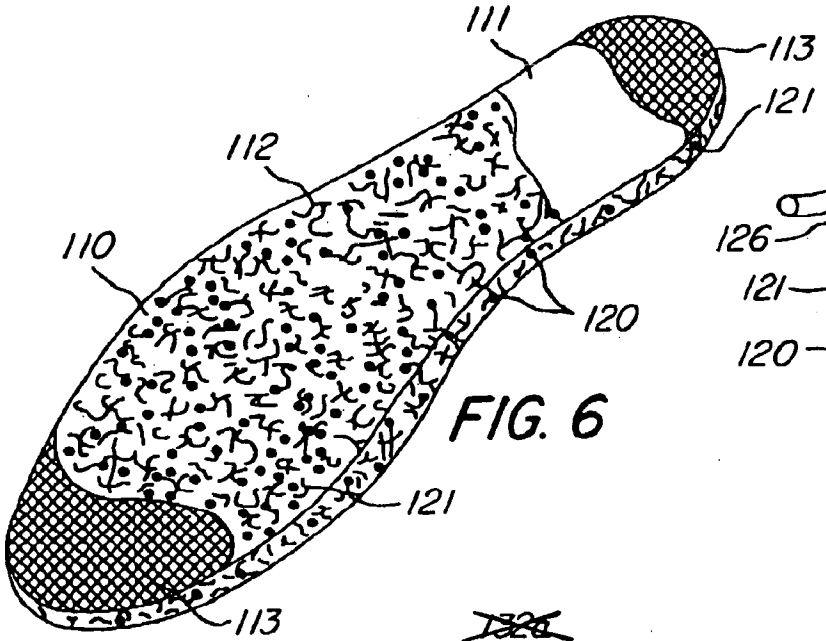
FIG. 6 shows a perspective view party broken away showing a two-layered composite material in accordance with the present invention, in the form of an insole.
Figure 7C:
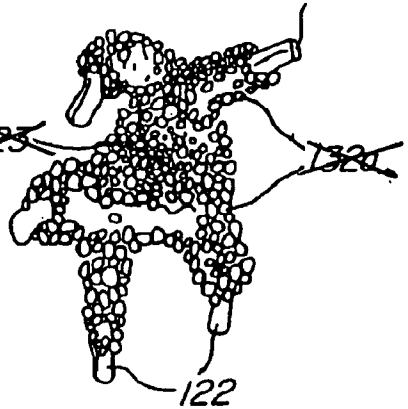
FIG. 7C is an enlarged view of the foam-encased fibers, shown in FIG. 4B.
Figure 7B:
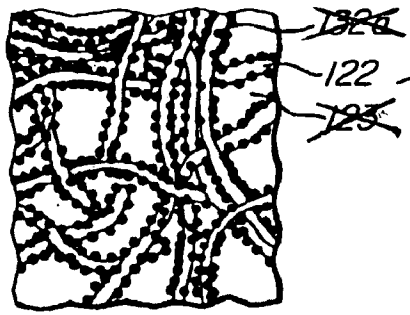
FIG. 7B is an enlarged fragmentary view showing the fibers when not under high compression in the three-layered composite material shown, in which the interstices of the non-woven material are not filled, in accordance with one embodiment of the present invention.
Figure 7A:
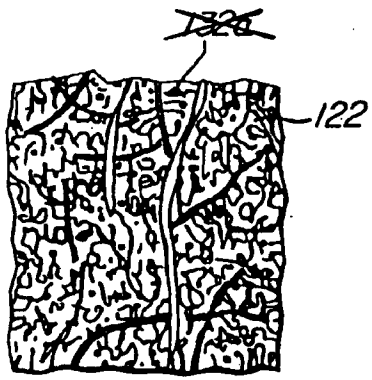
FIG. 7A is an enlarged fragmentary view showing a highly compressed fragment of the bottom or second layer of material shown in FIG. 3 in which all the interstices within the non-woven material are filled with the hydrophilic foam.

Another form of the composite material 110 in accordance with the present invention is shown in FIGS. 6 and 7 in which the cover layer 111, foam layer 112 hydrophilic with respect to the cover layer 111 and a bottom or third layer 113 is in the form of a non-woven fiber web or felted non-woven fiber web material. In this form of the composite material, depicted in FIGS. 6, 7, 7A, 7B and 7C, the non-woven fibers selected are preferably those having stiffening or thermoforming capabilities.

Non-woven webs of fibrous materials for this purpose are available in the commercial marketplace as polyester non-woven fibers coated with acrylic resin from Union Wadding of Pawtucket, R.I.; Carr Lee of Rockleigh, N.J.; Stearns Kem Wove of Charlotte, N.C.; and Loren Products of Lawrence, Mass. Such polyester non-woven webs of fibrous material are used in the present invention because of their durability, adhesion to the components of the respective aqueous mixtures, because they act to reduce shrinkage during the secondary drying steps in the formation of the foam layer 112 for the composite material being formed as is hereinafter described and because of the increase tensile strength they impart to thin films of the composite material, in accordance with the present invention, as those used in apparel and other products. Union Wadding supplies such preferred non-woven fibrous webs at 1½ to 3 ounces per yard (¼" to ½" thickness). These are polyester 3 and 6 denier fiber acrylic spray bonded thermoformable materials. These products are formulated to enhance thermoformability of the multi-layered composite material.

Similarly felted non-woven webs of fibrous material are also available in the commercial marketplace from Non Wovens Inc. of North Chelmsford, Mass., who supply their products 8 oz. per square yard, 0.080 thickness, 65% low melt polyester and 35% high melt polyester. These felted non-woven webs of fiber material provide the same improved characteristics to the foam layer 112 of the composite material 110 in accordance with the present invention as has been above described.

It should be noted that non-woven materials may also be introduced as a component of the polyurethane foam layer, rather than being bonded to the foam layer as a discrete third layer. The addition of the non-woven material within the foam layer adds strength, minimizes shrinkage in drying and acts as a wick for moisture transpiration into the foam layer. Such foam layers are formed by depositing the polymerizing foam onto a non-woven fiber web and compressing the foam-coated web to 10% of its thickness, thus coating the fibers of the web with the polymerized foam containing interstitial voids.

Figure 8:
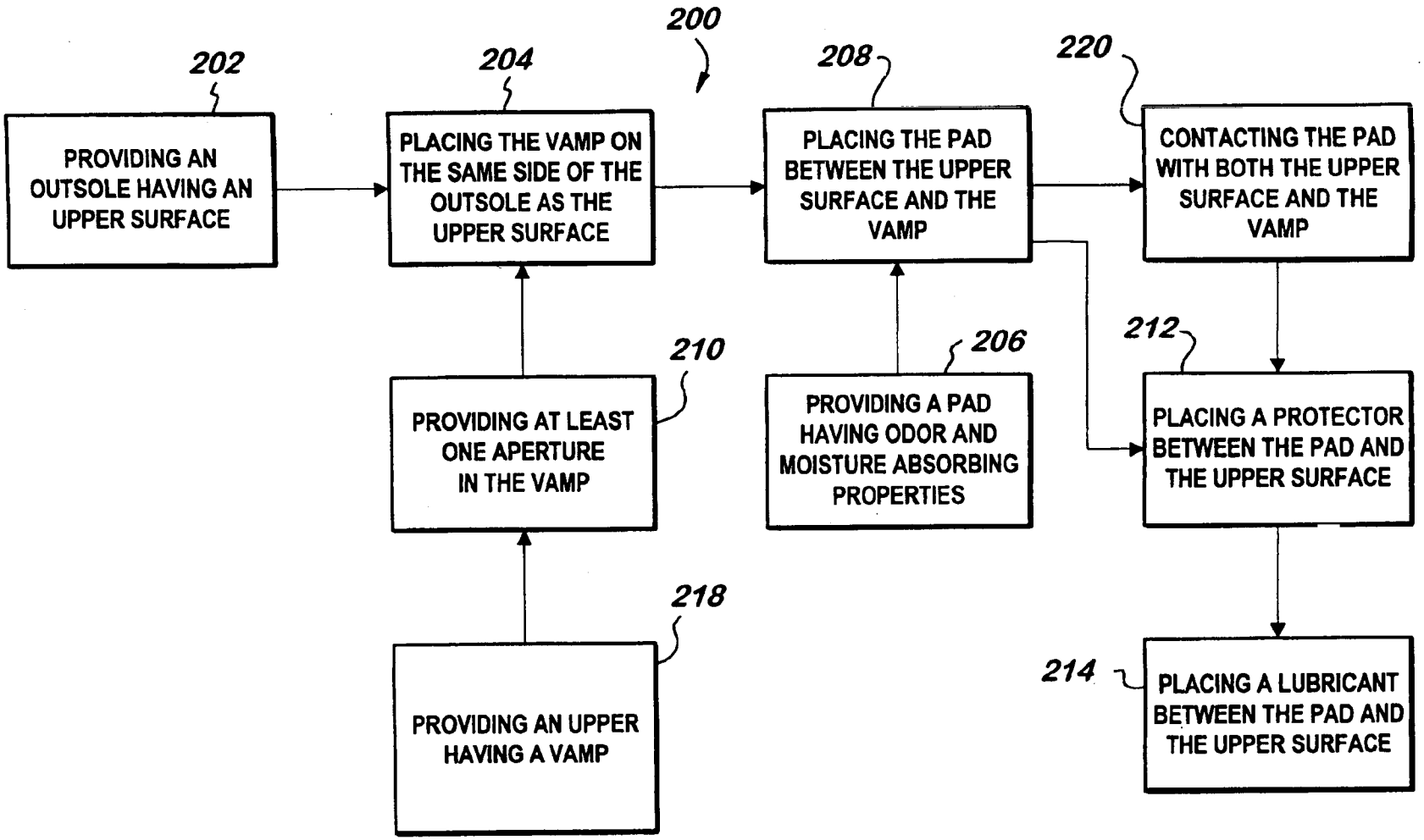
FIG. 8 depicts a method for providing the shoe shown in FIG. 1.

FIG. 8 depicts a method for providing the shoe in accordance with the invention. Method 200 includes the steps of providing 202 an outsole having an upper surface, providing 218 a bottom of the upper of an upper, placing 204 the bottom of the upper on the same side of the outsole as the upper surface, providing 206 a pad having an odor and moisture absorbing property, placing 208 the pad between the upper surface and the bottom of the upper, and providing 210 at least one aperture in the bottom of the upper proximate to the pad so that moisture and odor from a user's foot may diffuse through the at least one aperture and contact the pad.

In some embodiments, method 200 may also include the step of contacting 220 the pad with both the upper surface and the bottom of the upper. In other embodiments, method 200 may include placing 212 a protector between the pad and upper surface. The protector protects the pad from wear due to contact with the upper surface, where the wear is typically exacerbated during walking because the outsole is repeatedly flexed and bent. In these embodiments, the protector may be placed 212 in contact with both the upper surface and pad. In further embodiments, a layer of lubricant or other friction reducing agent may be placed 214 between the pad and upper surface to further aid in protecting the pad.

Method 200 also includes the step of placing 216 the pad over a localized area of the upper surface. The localized area may be a forepart, rearpart, or the entire upper surface of the shoe.

Although the invention has been described with reference to a particular arrangement of parts, features and the like, these are not intended to exhaust all possible arrangements or features, an indeed many other modifications and variations will be ascertainable to those of skill in the art.

What is claimed is:

1. A shoe, comprising:

an outsole having an upper surface;

a bottom of the upper placed on a side of said outsole the same as said upper surface;

a pad placed between said upper surface and said bottom of the upper;

said pad having an odor and moisture adsorbing property;

said bottom of the upper includes at least one aperture proximate to said pad for permitting moisture and odor to diffuse through said at least one aperture and contact said pad;

a protector placed beneath said pad and above said upper surface for protecting said pad; and a lubricant placed between said protector and said pad for reducing friction.

2. The shoe according to claim 1, wherein said pad is placed between said bottom of the upper and said upper surface without a need for a cavity.

3. The shoe according to claim 1, wherein said pad is in contact with said upper surface and said bottom of the upper.

4. The shoe according to claim 1, wherein said pad is a hydrophilic material.

5. The shoe according to claim 4, wherein said hydrophilic material is hydrophilic urethane.

6. The shoe according to claim 1, wherein said pad is placed over a localized area of said upper surface.

7. The shoe according to claim 6, wherein said localized surface is a forepart of the shoe.

8. The shoe according to claim 6, wherein said localized surface is a rear part of the shoe.

9. The shoe according to claim 6, wherein said localized surface is said upper surface.

10. A shoe, comprising:

an outsole having an upper surface;

a bottom of the upper placed on a side of said outsole the same as said upper surface;

a pad placed between said upper surface and said bottom of the upper;

said pad having a moisture adsorbing property;

said bottom of the upper includes at least one aperture proximate to said pad for permitting moisture to diffuse through said at least one aperture and contact said pad; and said pad further including at least one sorbent for gelling absorbed moisture.

11. A shoe, comprising:

an outsole having an upper surface;

a bottom of the upper placed on a side of said outsole the same as said upper surface;

a pad placed immediately adjacent to said upper surface and below said bottom of the upper;

a protector placed immediately adjacent to and in contact with both said pad and said bottom of the upper;

said pad having an odor and moisture adsorbing property;

said pad further including at least one sorbent for gelling absorbed moisture;

said bottom of the upper includes at least one aperture proximate to said pad for permitting the moisture and odor to diffuse through said at least one aperture and contact said pad;

wherein odor and moisture from a user passes through said at least one aperture and is absorbed in said pad; and wherein odor and moisture absorbed in said pad is released to the atmosphere upon the user removing a foot.

12. A method for providing a shoe, comprising the steps of:

providing an outsole having an upper surface;

placing a bottom of the upper of an upper on a side of the outsole the same as the upper surface;

providing a pad having an odor and moisture adsorbing property;

placing the pad between the upper surface and the bottom of the upper;

including at least one sorbent for gelling absorbed moisture; and providing at least one aperture in the bottom of the upper proximate to the pad for permitting moisture and odor to diffuse through the at least one aperture and contact the pad.

13. The method according to claim 12, further comprising the step of contacting the pad with both the bottom of the upper and the upper surface.

14. The method according to claim 12, further comprising the step of placing a protector between the pad and the upper surface to protect the pad.

15. The method according to claim 12, further comprising the step of placing the pad over a localized area of the upper surface.

* * * * *